US009173497B2

(12) United States Patent
Mastio

(10) Patent No.: US 9,173,497 B2
(45) Date of Patent: Nov. 3, 2015

(54) SEAT HAVING A FLEXIBLE CONNECTION

(76) Inventor: Emmanuel Antoine Mastio, Frenchs Forest (AU)

( * ) Notice: Subject to any disclaimer, the term of this patent is extended or adjusted under 35 U.S.C. 154(b) by 0 days.

(21) Appl. No.: 14/007,960

(22) PCT Filed: Mar. 30, 2012

(86) PCT No.: PCT/FR2012/050688

§ 371 (c)(1),
(2), (4) Date: Nov. 22, 2013

(87) PCT Pub. No.: WO2012/172210

PCT Pub. Date: Dec. 20, 2012

(65) Prior Publication Data

US 2014/0070582 A1 Mar. 13, 2014

(30) Foreign Application Priority Data

Mar. 31, 2011 (FR) ..... 11 00964

(51) Int. Cl.

| | |
|---|---|
| ***A47C 4/30*** | (2006.01) |
| ***A47C 7/46*** | (2006.01) |
| ***A47C 1/033*** | (2006.01) |
| ***A47C 4/20*** | (2006.01) |
| ***A47C 4/40*** | (2006.01) |
| ***A47C 1/032*** | (2006.01) |

(52) U.S. Cl.

CPC . *A47C 7/46* (2013.01); *A47C 1/033* (2013.01); *A47C 1/03227* (2013.01); *A47C 4/20* (2013.01); *A47C 4/30* (2013.01); *A47C 4/40* (2013.01)

(58) Field of Classification Search

CPC ..... A47C 4/28; A47C 4/30

USPC ..... 297/23, 55, 56, 284.2, 440.11, 452.13

See application file for complete search history.

(56) References Cited

U.S. PATENT DOCUMENTS

| | | | | | |
|---|---|---|---|---|---|
| 647,929 | A * | 4/1900 | Allen | 297/452.13 |
| 805,485 | A * | 11/1905 | Rice | 297/284.2 |
| 1,694,013 | A * | 12/1928 | Johnson | 297/271.4 |
| 1,694,933 | A * | 12/1928 | Walker et al. | 297/56 |
| 2,006,277 | A * | 6/1935 | Olsen | 297/452.13 |
| 2,505,702 | A * | 4/1950 | Benjamin | 297/28 |
| 3,992,056 | A * | 11/1976 | Koziatek et al. | 297/256.13 |
| 5,785,382 | A * | 7/1998 | Barker | 297/250.1 |
| 5,816,654 | A | 10/1998 | Ellis | |
| 7,147,277 | B1 * | 12/2006 | Miller | 297/284.2 |
| 2003/0155798 | A1 * | 8/2003 | Butler | 297/284.2 |
| 2008/0023994 | A1 * | 1/2008 | Jane Santamaria | 297/250.1 |

FOREIGN PATENT DOCUMENTS

| | | |
|---|---|---|
| CH | 183652 A | 4/1936 |
| DE | 26052 C | 5/1884 |
| NL | 15185 C | 3/1926 |

* cited by examiner

*Primary Examiner* — Peter Brown

(57) ABSTRACT

The invention concerns a seat forming a rigid sitting surface (8) and a backrest frame (1) globally oriented in intersecting directions in a crossover area situated towards the rear of the rigid sitting surface, characterized in that it includes a flexible sheet (3), in that the backrest frame includes a device (7) for suspension of said flexible sheet, disposed higher than the rigid sitting surface, in that said flexible sheet includes a transition panel (18) extending between the suspension device and an intersection area (9) globally in front of the suspension device, so that said transition panel serves as a rear sitting surface portion and a bottom backrest portion.

20 Claims, 5 Drawing Sheets

SEAT HAVING A FLEXIBLE CONNECTION

Figure 1:
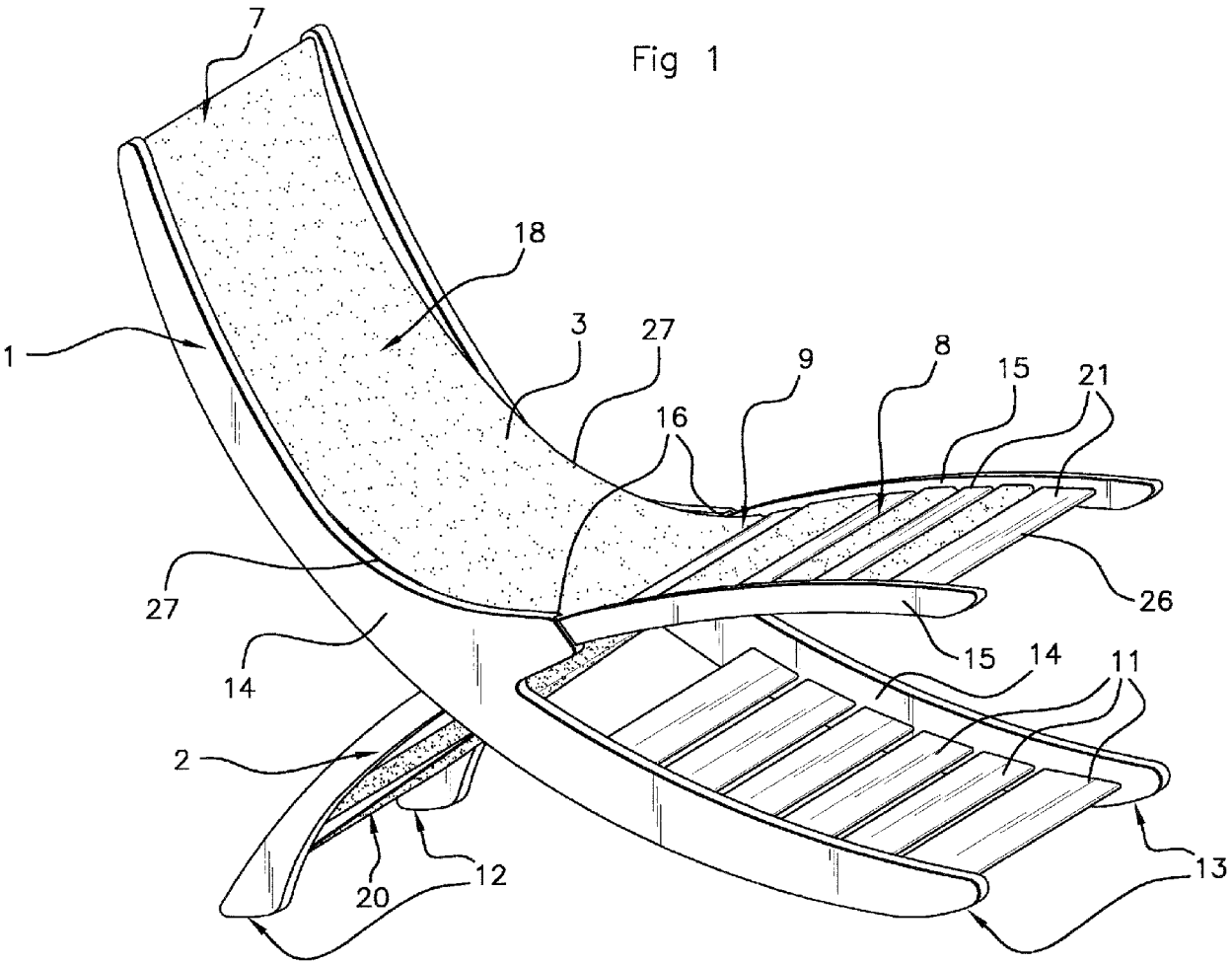

The invention concerns a seat, in particular a seat that can be used in different positions more or less stretched out. The invention notably concerns a seat combining ease of adjustment, mechanical simplicity, comfort and esthetics. The invention more particularly concerns a seat providing vertebral support, notably lumbar support respecting the natural lordosis of these vertebrae.

Numerous seats have been described, notably of lounger type. They often have either a rigid seat and back or a flexible sheet forming both seat and back, as in the case of a seat of the deck chair type. Neither one nor the other is truly comfortable, because neither respects the natural curvatures of the back.

Furthermore, esthetics are often antagonistic to comfort. Thus there are known esthetics seats of simple mechanical structure as described in EP 0 117 827 including two crossed structures bearing one on the other. However, this type of seat provides rigid back support to the detriment of the comfort of the user.

Also known are seats combining rigid and flexible surfaces, as described in GB 708,314, but they generally remain uncomfortable to sit in because of a poor position of the lumbar vertebrae, which adopt a bad position in them.

Thus it is very difficult to combine esthetics, ease of adjustment, mechanical simplicity, comfort and respect for the natural curvatures of the back.

The invention therefore aims to propose a seat meeting these criteria until now considered antagonistic.

The invention aims to propose a seat that is comfortable in a plurality of more or less stretched out configurations.

The invention also aims to propose a seat that is simple to adjust, notably that can be adjusted by a single person without great effort.

The invention further aims to propose a seat that respects the natural curvatures of the back, notably corresponding to a standing position.

The invention equally aims to propose such a seat that is structurally simple and elegant.

The invention therefore concerns a seat in accordance to the independent claims. Other characteristics are specified in their dependent claims.

A seat in accordance with the invention may include any type of frame, in one or more parts, made from any type of material. The seat in accordance with the invention may be of chair, lounger, armchair, theatre seat, wheelchair, motor vehicle seat, etc. type.

A rigid sitting surface in accordance with the invention is a sitting surface for a user, i.e. a surface designed to receive the buttocks of a user of the seat and therefore to support a major part of the weight of the user. However, the user is not necessarily in direct contact with the rigid sitting surface. Thus the user may be sitting at least in part on the flexible sheet, in particular on the transition panel of the flexible sheet, the flexible sheet panel receiving the user's buttocks being itself in contact with the rigid sitting surface and therefore trapped between the buttocks and the rigid sitting surface.

This is why, advantageously and in accordance with the invention, the rigid sitting surface is extended to the rear of the intersection area. Thus the flexible sheet can, by deforming and/or being rearranged downward by the effect of the weight of a user, come in part into contact with the rigid sitting surface so as to provide the user with a rigid support.

Thus there exists an area to the rear of the intersection area in which the flexible sheet and the rigid sitting surface are superposed. The front portion of the transition panel comes into contact with the rigid sitting surface when a user is sitting in the seat.

In a seat in accordance with the invention the flexible sheet includes a panel referred to as the transition panel extending from the joining means with the rigid sitting surface to a suspension device.

The flexible sheet may extend beyond the suspension device and/or beyond the intersection area. This arrangement is even advantageous and allows the transition panel to have a length adapted to different stable positions of the seat.

A seat in accordance with the invention may have only one stable position (this is the case of a classic chair) but can also have a plurality of stable positions: this is the case for example of a lounger which has at least a more stretched out configuration and a more raised (or sitting up) configuration.

A flexible sheet in accordance with the invention may be of any kind. In particular it is flexible in longitudinal flexing (the longitudinal direction being defined with respect to the sitting surface/backrest axis). However, there is nothing to prevent it from being flexible transversely.

A flexible sheet in accordance with the invention may be in one piece, for example of woven canvas. Alternatively, a flexible sheet in accordance with the invention may consist of a plurality of substantially parallel cords and/or strips.

Moreover, a flexible sheet is advantageously not elastic or not very elastic so as to be able to provide support when tensioned.

Advantageously and in accordance with the invention the surface defined by the flexible sheet is joined to the rigid sitting surface in the intersection area. In particular, the flexible sheet is tangential to or intersects the rigid sitting surface, notably when a user is sitting in the seat. Thus the flexible sheet which is in part superposed with the rigid sitting surface enables a transition to be provided between rigid support by the sitting surface and flexible support for the lower back thanks to the joining panel of the flexible sheet.

In accordance with the invention the rigid sitting surface includes in the intersection area joining means with the flexible sheet. These means are adapted to retain the flexible sheet in or at least to impose passage of the flexible sheet through a predetermined intersection area. Such joining means are chosen to be able to impose the passage of the flexible sheet through this location, even when a user is sitting in the seat. Such joining means are notably adapted to retain the transition panel in position when the flexible sheet is tensioned by a user sitting in the seat.

Such joining means may be attachment means by which the flexible sheet is attached or passage means through which the flexible sheet passes. Thus the flexible sheet may be fixed to the rigid sitting surface in the intersection area by joining means such as: clips, glue, stitches, anchor means, etc. Alternatively, the intersection area may include joining means obliging the flexible sheet to pass through this area without being anchored there. For example, such joining means may consist of a slot in which the flexible sheet is mounted so that it can slide, the flexible sheet being anchored further on to the backrest frame or to the sitting surface frame, for example.

Such joining means are not necessarily fixed relative to the frame of the seat, and notably relative to the rigid sitting surface. For example, the joining means may therefore be adjustable along the rigid sitting surface, from front to back for example, so as to adjust the length and the position of the transition panel as a function of different factors (configuration of the seat, weight of the user, child or adult user, required level of comfort, etc.).

Moreover, the transition panel of a flexible sheet is suspended from a suspension device. Such a suspension device may be of any type, for example: one or more points of attachment of the flexible sheet to the backrest frame, a suspension crossmember above which the flexible sheet can slide from front to back (or from back to front), a device with rollers between which the flexible sheet is routed (or a device with a single roller over which the flexible sheet is routed), a slot through which the flexible sheet passes and which forms a device for changing its direction, etc. The suspension device imposes the passage of the flexible sheet in this area. The suspension device in accordance with the invention is adapted to be able to support the weight of a user.

Moreover, the intersection area is situated in front of the suspension device. The intersection area is generally globally linear and the suspension device likewise. The vertical plane containing the intersection area is situated in front of the vertical plane containing the suspension device. As a result the transition panel really provides a flexible rear-to-front, top-to-bottom transition between the bottom of the backrest and the rear of the sitting surface.

In particular, the rear sitting surface portion is just below an anterior portion of the transition panel of the flexible sheet. To this end, the rear sitting surface portion does not include any sudden surface variation and advantageously forms a continuous surface in the area of intersection with the rigid front sitting surface portion.

Furthermore, the rear sitting surface portion is inclined downwards toward the rear. When a user sits in the seat, their weight is therefore exerted on the anterior portion of the transition panel and tensions the transition panel, forming a pronounced downward bulge, so that the user's buttocks are supported on an anterior area, referred to as the superposition portion, of the rigid rear sitting surface portion. The pelvis of the user is therefore held rotated forwards, which respects the natural lordosis of the lumbar vertebrae. The length of the superposition portion, in which the flexible sheet is in contact with the rigid sitting surface, notably varies as a function of the configuration of the seat and the morphology and weight of the user.

On then leaning back in the seat, the user deforms the transition panel which, being flexible but rigid in traction (inelastic), adapts to their morphology and their weight. At least part of the downward bulge formed by an anterior portion of the transition panel is then raised so that the pelvis of the user is raised and retained in a position rotated forwards to respect the lordosis of the lumbar vertebrae.

A correct position of the lumbar vertebrae is therefore adopted naturally from the first stage of sitting down in a seat in accordance with the invention and is then maintained, whether the flexible sheet remains in contact with said superposition portion or not.

To this end, advantageously and in accordance with the invention, the length of the transition panel is adapted so that when a user sits down in the seat the transition panel comes into contact with said superposition portion. The transition panel is made sufficiently long to form a downward bulge, notably lower than the front sitting surface portion, and coming into contact with the rear sitting surface portion to accommodate a user's buttocks comfortably at the same time as being relatively short and tensioned so as to give the user the sensation of being supported.

In particular, advantageously and in accordance with the invention, the length of the transition panel is at least 5% greater than the distance between the suspension device and the intersection area.

The separation area is an area in which the transition panel of the flexible sheet separates from contact with the rigid sitting surface. The separation area divides the rear sitting surface portion into:

- a separated portion extending from the sitting surface rear edge to the separation area, in which the transition panel is suspended above and without contact with the rigid sitting surface, and
- a superposition portion extending from the separation area to the intersection area, in which the transition panel is in contact with the rigid sitting surface.

The position of the separation area (and therefore the extent of the separation and superposition portions) between the rear sitting surface edge and the intersection area varies as a function notably of the configuration of the seat and the morphology and the weight of the user.

Likewise the position of the separation area between the rear sitting surface edge and the intersection area varies during movement of a user to sit down in the seat.

The length of the transition panel is such that the superposition portion has a length of at least 2 cm, notably at least 10 cm and more particularly at least 15 cm, and less than 50 cm, notably less than 30 cm, so that the separation area is separate from the intersection area. The length of the transition panel is more particularly such that the superposition portion has a length of at least 2 cm when no user is sitting in the seat, i.e. when the supporting panel is subjected only to its own weight.

The length of the transition panel is less than the sum increased by 5% of the distance between the suspension device and the rear sitting surface edge and the distance between the rear sitting surface edge and the intersection area, so that the separation area is separate from the rear sitting surface edge. The separation area therefore extends strictly between the rear edge of the rigid sitting surface and said intersection area.

When a user is sitting in the seat, the flexible sheet (and therefore the transition panel in particular) is advantageously tensioned by the weight of the user so as to support the user at least in part. The transition panel of the flexible sheet enables a flexible transition to be created between backrest and sitting surface. In fact the transition panel adapts to the curvature of the lower back.

Now, the transition area between backrest and sitting surface is an area that is essential for the comfort of a seat, in particular a chair in which the backrest and/or the sitting surface is rigid. In fact, this area receives the lumbar vertebrae of the user, which are very highly loaded because they support a great part of the weight of a person. In many entirely flexible seats, such as deck chairs, the lumbar vertebrae of the user are supported only by a flexible sheet but the rounded general shape that this sheet assumes because of the effect of the weight of the user does not respect the lordosis of the lumbar vertebrae (forced cyphosis of the lumbar vertebrae). Moreover, in such chairs, the flexible sheet is held by a bar at the front of the seat that is particularly uncomfortable for the legs. In contrast, in chairs that are entirely rigid the lumbar vertebrae are not supported because these chairs generally feature a gap between backrest and sitting surface.

In a seat in accordance with the invention, on the other hand, rigid support is provided for the user's legs and buttocks by a rigid sitting surface and effective and comfortable support of the lumbar vertebrae is assured, notably respecting the lordosis of the lumbar vertebrae.

Moreover, advantageously and in accordance with the invention, the lateral edges of the transition panel are free edges. The transition panel therefore adopts a shape perfectly adapted to the morphology of a user.

The length of the transition panel and the shape of the rear sitting surface portion are furthermore advantageously adapted so that the separation area is located in front of the suspension device so that the angle formed by the trunk-thighs dihedron of a user sitting in the seat is greater than or equal to 90°. Such an angle makes it possible to provide comfort when sitting and a good position of the vertebrae.

The rear sitting surface portion and more particularly the superposition portion has a slope inclined downwards toward the rear between 2° and 45° relative to the horizontal when the chair is placed with its leg assemblies on a horizontal surface, notably of around 30°. Moreover, the rear sitting surface portion has a minimum depth, from the rear edge of the rigid sitting surface to the intersection area, of approximately 10 cm, and the front sitting surface portion has a minimum depth, from the intersection area to the front edge of the rigid sitting surface, of approximately 5 cm. These dimensions correspond to a lounger in a stretched out position for a user of average height.

Moreover, advantageously and in accordance with the invention, the flexible sheet forms at least one second panel, referred to as the supporting panel, extending behind and near the transition panel, between the suspension device and a device forcing the flexible sheet to pass through this location, so that, the flexible sheet being tensioned, the supporting panel increases the firmness of a backrest portion formed by the transition panel.

The supporting panel makes it possible to line the transition panel, notably on the backrest portion formed by the transition panel. Thus the user of a seat in accordance with the invention has the benefit of increased support in the lower back: the tensions in the transition panel and the supporting panel are cumulative in this area and provide better support for the lumbar vertebrae. The supporting panel notably enables the natural shape in lordosis of the lumbar area of the back to be respected.

To this end, the supporting panel is advantageously disposed a few centimeters to the rear of the backrest portion formed by the transition panel so that the transition panel and the supporting panel are superposed. Thus when a user sits down in the seat, his weight tensions the flexible sheet and the transition panel adapts to the shape of the user. Because of the weight of the user, the transition panel is deformed slightly towards the rear, so as to come into contact with the tensioned supporting panel, which provides additional support at least over the backrest portion of the transition panel.

The supporting panel is advantageously tensioned between the suspension device and a device forcing it to pass through a bottom area of the seat, for example in the vicinity of the crossover area. Such a device serves to change the direction of the flexible sheet, i.e. enables the main direction of the flexible sheet to be changed. Such a device is formed for example of means for anchoring the flexible sheet or a crossmember for changing the direction of the flexible sheet over which the latter may slide, and so on.

In particular, a seat in accordance with the invention advantageously comprises a frame adapted to be placed in at least two different stable configurations, the length of the transition panel varying as a function of the configuration of the seat.

Against all expectations, the inventor has succeeded in producing a seat of variable configuration, the sitting surface of which is rigid and at least a portion of which is provided by a flexible sheet. Self-regulation (i.e. automatic adjustment as a function of the configuration of the seat) of the length of the transition panel as a function of the configuration of the seat is a particularly advantageous feature specific to the invention, and is obtained in a simple manner.

Such a seat therefore advantageously has a first position, referred to as a sitting position, in which the backrest is more raised than in a second position, referred to as a stretched out position, in which the backrest is more laid back.

Advantageously and in accordance with the invention, the flexible sheet can therefore slide from front to rear (and from rear to front) through or over the suspension device. In this way, the length of the transition panel and the tension in the transition and supporting panels adapt spontaneously as a function of the configuration of the seat, the weight of the user, etc. without the user having to effect any specific action of adjusting the flexible sheet, notably without having to detach and then re-attach the flexible sheet.

In order for the flexible sheet to be correctly tensioned when a user sits down in the seat, advantageously and in accordance with the invention, two separate portions of the flexible sheet are anchored into the seat.

Thus the flexible sheet is tensioned between these two anchoring areas when a user sits down in the seat. In particular, the supporting and transition panels lie between these two anchoring areas.

The frame of the seat comprises the backrest frame and the rigid sitting surface as well as a rigid frame supporting the rigid sitting surface, leg assemblies, etc. The frame of a seat in accordance with the invention may be in one or more parts and the flexible sheet may be anchored to the seat at any point.

A seat in accordance with the invention is advantageously also characterized in that the joining means of the intersection area include at least one slot passing through the rigid sitting surface, the flexible sheet being mounted so as to pass through this slot.

The flexible sheet passes through a slot that is substantially parallel to the crossover area between the directions defined by the backrest and the sitting surface of the seat. In particular, such a slot is substantially parallel to the flexible sheet suspension device.

The rigid sitting surface may include a plurality of slots in order to be able to adjust how far the transition panel extends toward the front of the seat by choosing the slot through which the flexible sheet passes. The flexible sheet is advantageously anchored to the frame of the seat in a portion situated beyond where it passes through the slot relative to the transition panel.

This slot changes the direction of the flexible sheet and obliges the latter to pass through a clearly defined area of intersection with the rigid sitting surface. This is why it constitutes joining means between the flexible sheet and the rigid sitting surface.

Furthermore, advantageously and in accordance with the invention, the flexible sheet being a strip rigid in traction, the transition panel has a length between the suspension device and the intersection area that is strictly greater than the minimum distance between the suspension device and the intersection area.

Advantageously and in accordance with the invention, the flexible sheet is inelastic in its longitudinal direction. Moreover, it is longer than the minimum length between the two areas in which it is anchored so that it adapts to different configurations of the seat as well as to the shape and the weight of a user. In particular, the transition panel has a length greater than or equal to the shortest distance between the suspension device and the joining means. The transition panel therefore forms a bulge.

Using a flexible sheet rigid in traction enables greater user comfort to be provided. Such a flexible sheet may be a canvas sheet, for example.

Moreover, the frame of a seat in accordance with the invention advantageously comprises:

a rigid sitting surface frame.

a rigid backrest frame, different from the rigid sitting surface frame, and including the flexible sheet suspension device, said sitting surface and backrest frames being assembled to each other so as to be able to form at least one stable configuration of the seat in which they cross over in the crossover area, the backrest frame extending upwards relative to the crossover area and the sitting surface frame having a rigid seating surface in front of the crossover area.

The sitting surface frame therefore includes the rigid sitting surface in front of the crossover area. Similarly, the backrest frame may include a rigid backrest top portion. Alternatively, the backrest frame may serve only to support the suspension device, the whole of the backrest being formed by the flexible sheet, notably via its transition panel.

Also, advantageously and in accordance with the invention:

the sitting surface frame has a globally elongate shape and forms a rear leg assembly of the seat, the backrest frame has a globally elongate shape and forms a front leg assembly of the seat.

The sitting surface and backrest frames of a seat in accordance with the invention advantageously have elongate shapes defining surfaces crossing over in or near the crossover area.

Moreover the front and rear leg assemblies of the seat form at least three non-aligned bearing points to ensure the stability of the seat on the ground. A seat may have two bearing points of the front leg assembly and two bearing points of the rear leg assembly.

Moreover, advantageously and in accordance with the invention, said sitting surface and backrest frames include assembly means enabling them to slide relative to each other from one stable configuration of the seat to another stable configuration of the seat.

Such assembly means may be of any kind provided that they enable sliding on one frame relative to the other to go from one configuration of the seat to another as well as immobilizing the frames relative to each other to maintain a stable configuration of the seat.

The crossover area is generally mobile as a function of the configuration of the seat.

Moreover, advantageously, in a seat in accordance with the invention, the backrest frame is adapted to slide along the sitting surface frame to go from one stable configuration of the seat to another stable configuration of the seat.

This is why, in one particularly advantageous embodiment of the invention, the backrest frame includes grooves and the sitting surface frame includes tongues, the grooves and the tongues being adapted so that:

the tongues can slide longitudinally in the grooves to go from one stable configuration of the seat to another stable configuration of the seat, the tongues can be immobilized by wedging them in the grooves for each configuration of the seat between at least first and second stable configurations of the seat.

To this end, the grooves are advantageously wider than the tongues with which they cooperate. This facilitates sliding of the tongues in the grooves and also enables immobilization of the tongues in the grooves through wedging of the tongues in the grooves. The wedging occurs when the main direction of a tongue is not collinear with and sufficiently secant with respect to the main direction of a groove. When a tongue is wedged in a groove it can no longer slide therein and this immobilization enables the seat to be retained in a stable configuration. Immobilization by wedging is advantageously reinforced when a user is sitting in the seat.

In particular, advantageously and in accordance with the invention, the sitting surface frame includes a rigid frame assembly including two lateral longitudinal members:

each forming one of the rear leg assemblies, adapted to slide in grooves in the backrest frame to go from one stable configuration of the seat to another stable configuration of the seat, between which extends, toward the front of the crossover area, a plurality of slats spaced by slots and forming the rigid sitting surface.

Moreover, advantageously and in accordance with the invention, the backrest frame includes a rigid frame assembly including two lateral longitudinal members:

each forming one of the front leg assemblies, connected by a flexible sheet suspension crossmember, including grooves so as to be able to slide on the sitting surface frame to go from one stable configuration of the seat to another stable configuration of the seat, widened at the level of the grooves to enable immobilization of the sitting surface frame by wedging in these grooves.

The sitting surface and backrest frames therefore indeed crossover: the sitting surface frame extends from the rear, where it forms the rear leg assembly, to the front, where it features the rigid sitting surface. For its part, the backrest frame extends from the front of the seat, where it forms the front leg assembly, upwards and substantially rearwards, where it includes the flexible sheet suspension device. The crossover area is defined by where they cross over.

The lateral longitudinal members of the sitting surface frame advantageously slide in grooves formed on the interior face of the longitudinal members of the backrest frame. The longitudinal members of the sitting surface frame and the grooves of the backrest frame being adapted to cooperate so that a user can easily modify the configuration of the seat by sliding the sitting surface frame relative to the backrest frame, and so that the longitudinal members of the sitting surface frame can be immobilized by wedging in the grooves of the backrest frame.

Such an arrangement in particular enables a seat in accordance with the invention to adopt all possible configurations between an extreme seated position and an extreme stretched out position. In fact, the configuration of the seat is not adjusted by means of predetermined detents but progressively anywhere along the longitudinal member of the sitting surface frame between its two extreme positions.

Moreover, the inventor has determined that in a seat in accordance with the invention with double backrest and sitting surface frame:

the flexible sheet is advantageously anchored to the sitting surface frame in the vicinity of the rear leg assembly, the flexible sheet is advantageously anchored to the sitting surface frame in the front half of the rigid sitting surface.

Thus the flexible sheet extends from its anchor point in the vicinity of the rear leg assembly as far as the device for changing the direction of the flexible sheet situated in the vicinity of the crossover area, forming the start of the supporting panel. The supporting panel is continuous from the direction-changing device to the suspension device. The transition panel is then continuous with the supporting panel from the suspension device to the area of intersection with the rigid sitting surface, the intersection area advantageously being formed by a transverse slot in the rigid sitting surface, through which the flexible sheet passes. After this intersection area the flexible sheet is then extended as far as the point at which it is anchored to the sitting surface frame, in the front half of the rigid sitting surface.

There is nothing to prevent the flexible sheet passing through other slots and/or direction-changing devices. In particular, the flexible sheet may pass through a plurality of successive direction-changing devices for technical and/or esthetic reasons.

In fact, the additional lengths of flexible sheet extending beyond the supporting and transition panels enable the length of the latter to be adapted as a function of the configuration of the seat. In particular, the sliding connection between a rear supporting panel and the transition panel can allow adjustment of the length of (and therefore the tension in) the transition panel as a function of the configuration of the seat. Also, the flexible sheet may pass more than once over and under the rigid seat surface, through the slots separating the slats constituting this rigid sitting surface, notably enabling an esthetic transition between flexible sheet and rigid sitting surface.

Furthermore, other embodiments may be envisaged with other flexible sheet anchor points: for example, the flexible sheet may be anchored to the backrest frame in the vicinity of the front leg assembly instead of being anchored in the front half of the rigid sitting surface.

Such a configuration with double frame and immobilization by wedging between at least two different positions is particularly advantageous when the seat in accordance with the invention is a lounger.

In some embodiments, the material and the anchor areas of the flexible sheet are chosen so that when a user sits down in the seat, in at least one stable configuration of the seat, said flexible sheet adopts a shape adapted to support the back of the user and to support the user's buttocks progressively on the rigid sitting surface so that the user is in contact with the flexible sheet but seated on (and therefore supported by) the rigid sitting surface.

The invention also concerns a seat characterized by a combination of some or all of the features referred to hereinabove or hereinafter.

Furthermore, the invention also concerns a kit in accordance to the kit claims.

In fact, such a seat may advantageously be packaged and sold in the form of a kit or set of separate components adapted to be assembled. Such a kit advantageously comprises all the components necessary to produce a seat in accordance with the invention, including the parts for assembling it (screws, etc.). Such a kit is advantageously accompanied by assembly instructions.

All the components of a seat in accordance with the invention area advantageously adapted, when demounted, to be contained within a small volume transportable by at least one person and easily loaded into a family vehicle (private car).

Figure 2:
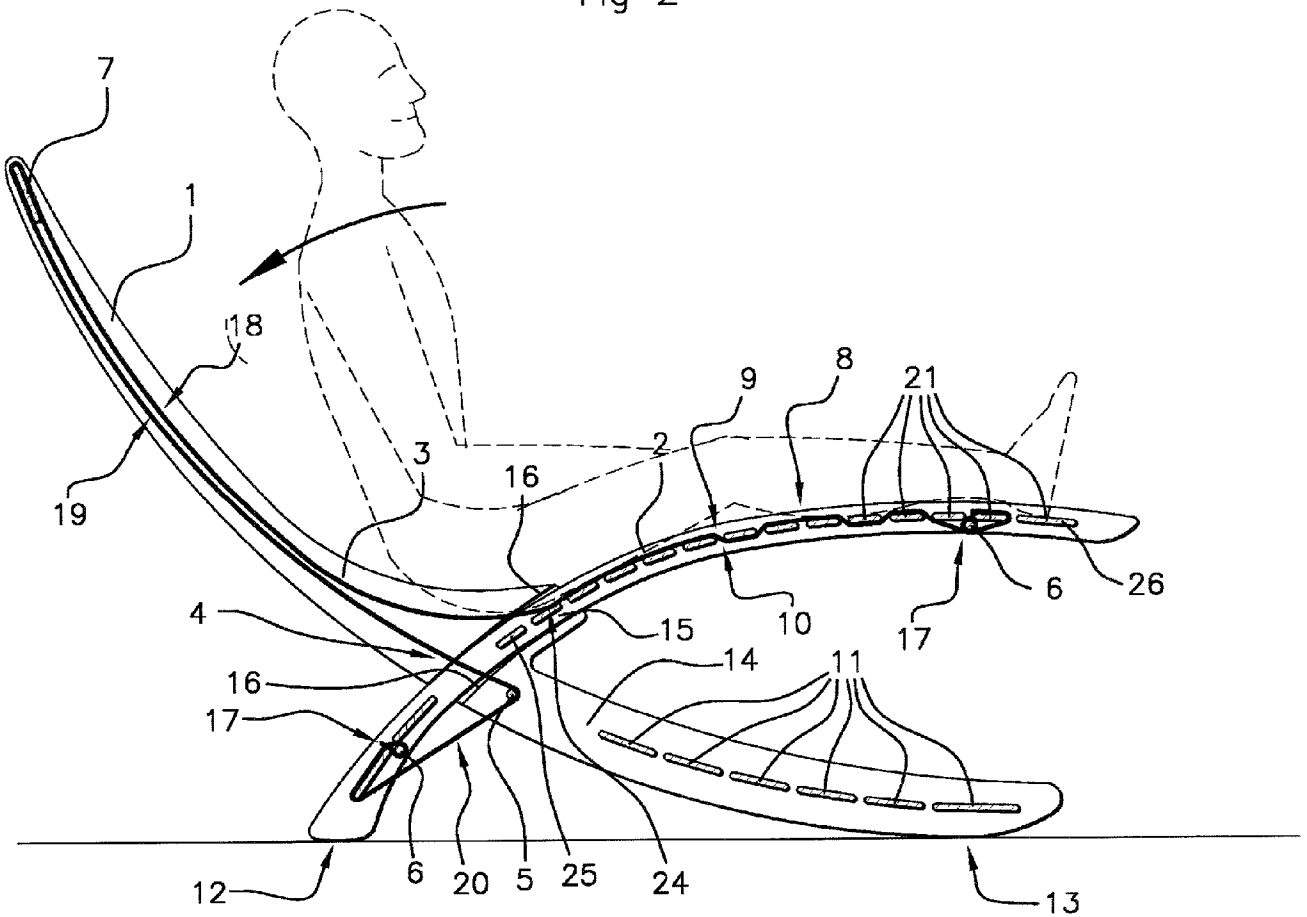
Figure 3:
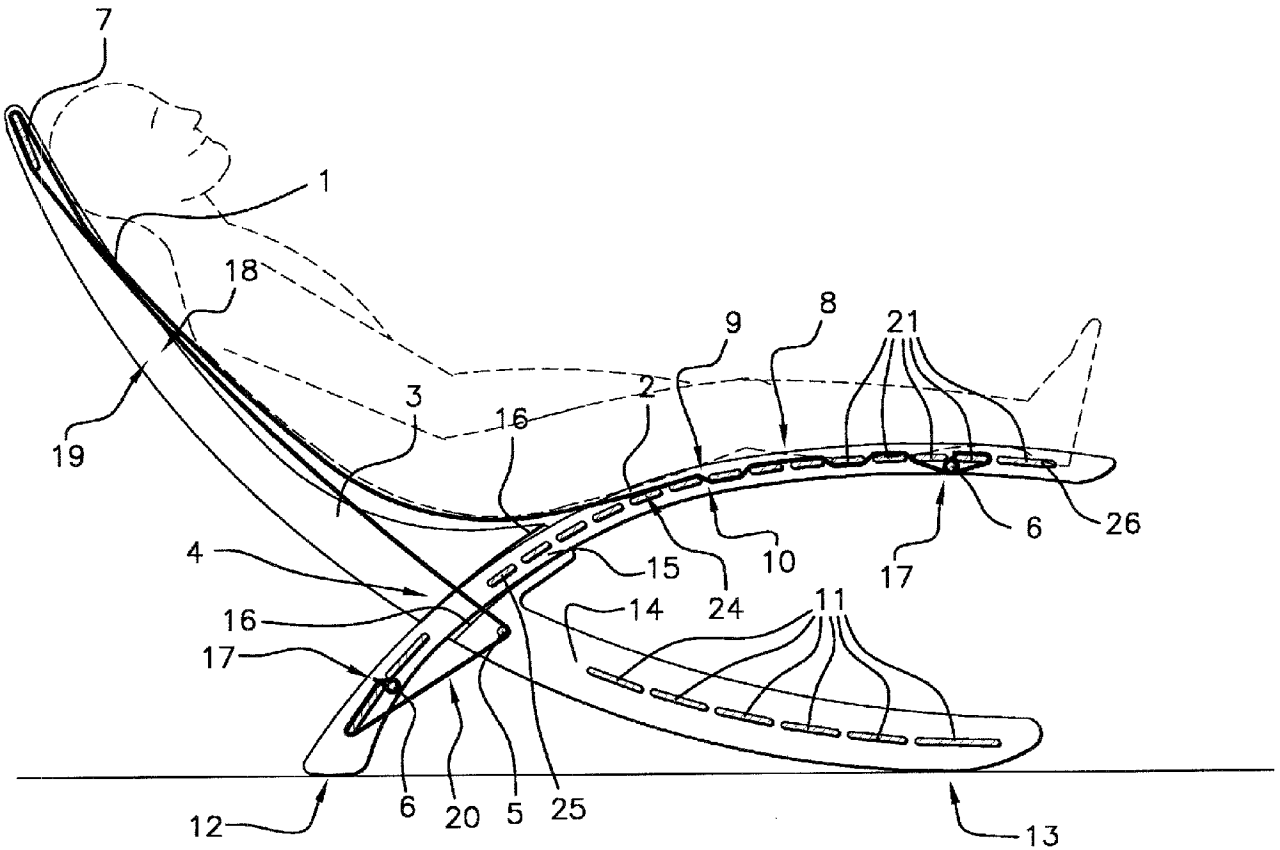
Figure 4:
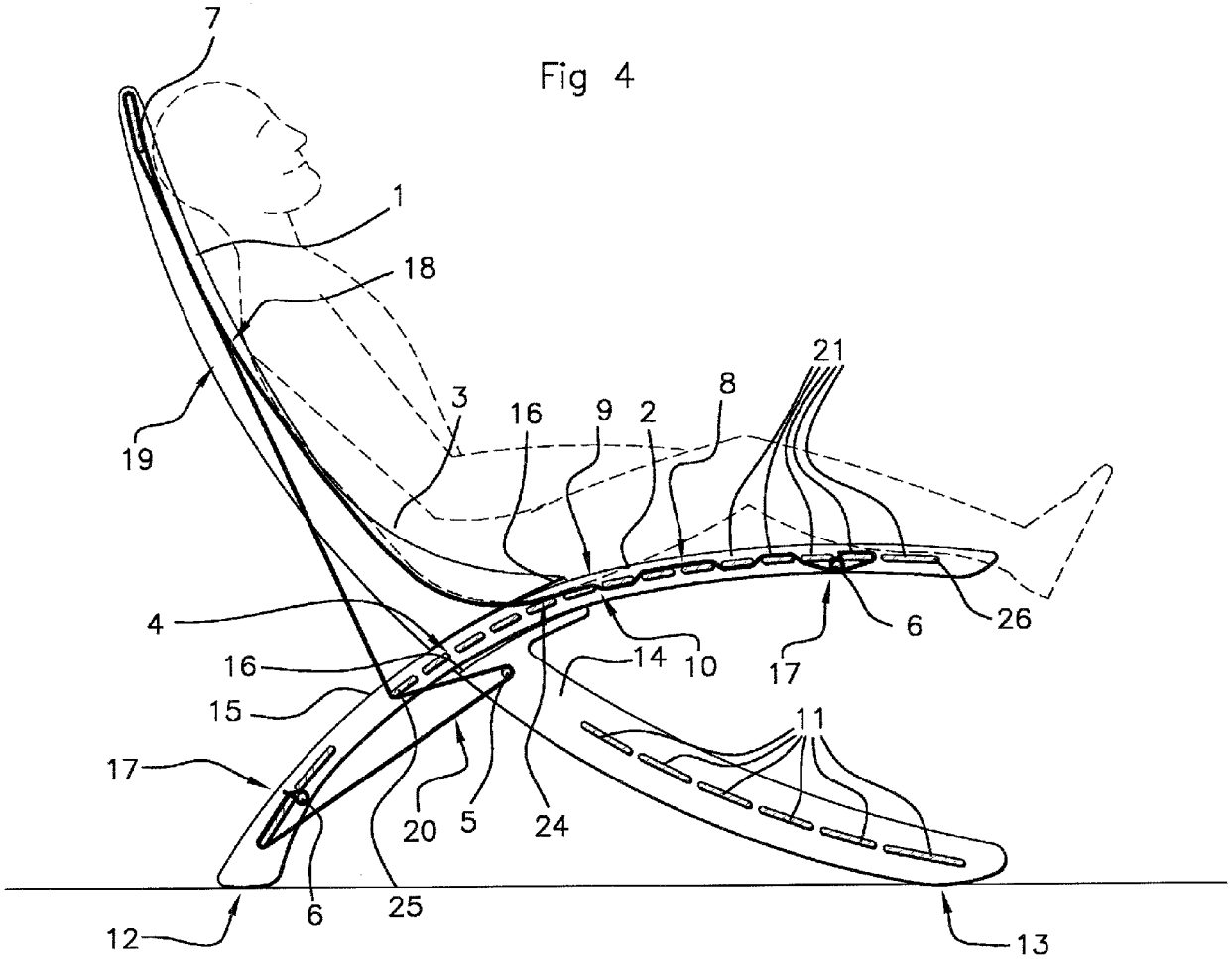
Figure 6:
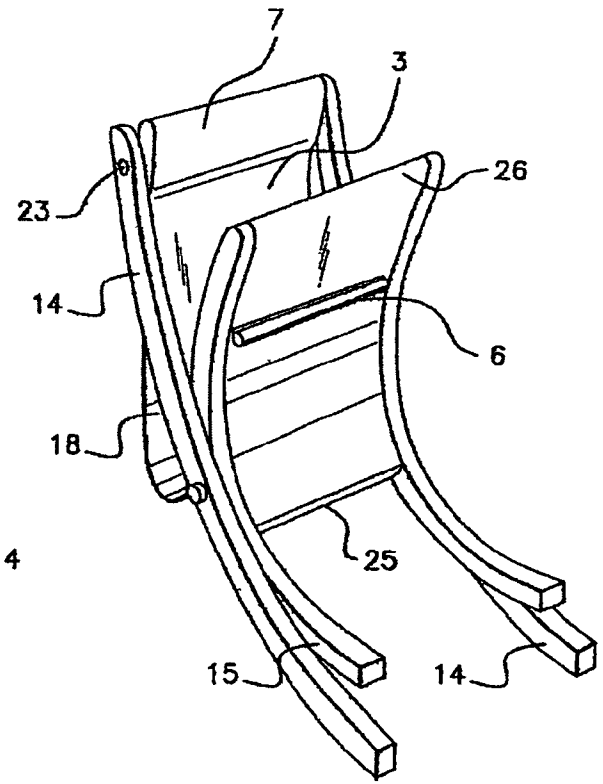
Figure 5:
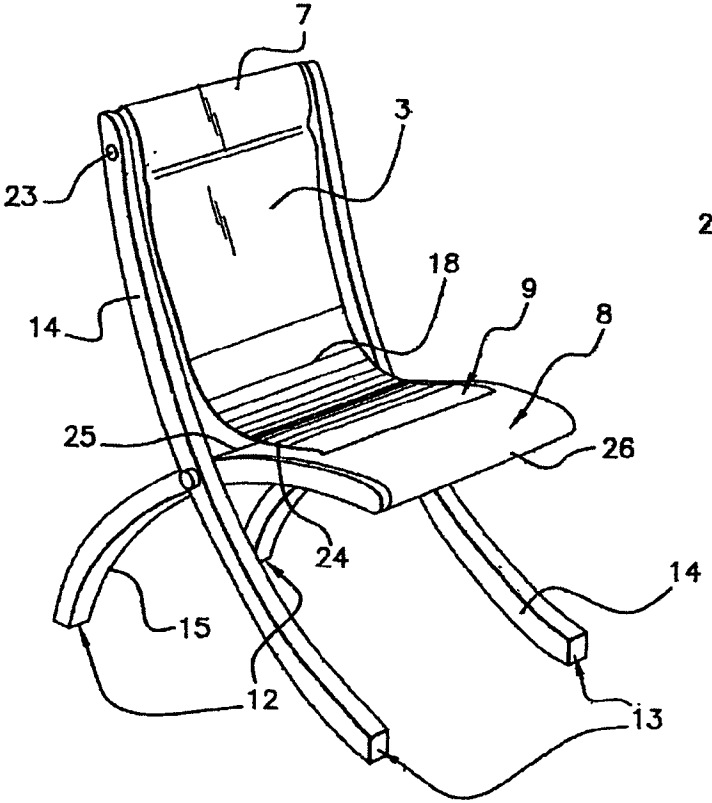

Other objects, features and advantages of the invention will appear on reading the description given hereinafter by way of nonlimiting illustration and with reference to the appended figures, in which:

FIG. 1 is a diagrammatic view in three-quarter profile as seen from the right-hand side of a first embodiment of a seat in accordance with the invention, FIG. 2 is a diagrammatic view in cross section in a sagittal plane of the seat from FIG. 1 in a first configuration when a user sits down on the seat, FIG. 3 is a diagrammatic view in cross section on a sagittal plane of the seat from FIGS. 1 and 2 in the first configuration shown in FIG. 2 with a user seated in and leaning back in the seat, FIG. 4 is a diagrammatic view in cross section in a sagittal plane of the seat from FIGS. 1, 2 and 3 in a second configuration with a user sitting on the seat, FIG. 5 is a diagrammatic view in three-quarter profile as seen from the right-hand side of a second embodiment of a seat in accordance with the invention in a stable configuration, and FIG. 6 is a diagrammatic view in three-quarter profile as seen from the right-hand side of the second embodiment of a seat in accordance with the invention as shown in FIG. 5 in a transport configuration.

A seat in accordance with the first particular embodiment of the invention represented in FIGS. 1, 2, 3 and 4 is a lounger. The lounger has two frames that cross over: a backrest frame 1 and a sitting surface frame 2 that cross over in a crossover area 4. The backrest frame 1 comprises two lateral longitudinal members 14 forming front leg assembly 13 at one end and connected to each other by slats 11. The slats 11 enable reinforcement of the structure of the backrest frame and may also have an esthetic role. Furthermore, the two longitudinal members 14 of the backrest frame 1 are connected near their upper ends, opposite the front leg assembly 13, by a suspension device taking the form of a suspension crossmember 7.

The sitting surface frame 2 comprises two lateral longitudinal members 15 forming a rear leg assembly 12 at one end, the two lateral longitudinal members 15 being connected to each other by slats 21. In front of the crossover area 4 the sitting surface frame includes a plurality of slats 21 spaced from one another by narrow slots, the slats 21 forming a rigid sitting surface 8 that extends from a rear edge 25 to a front edge 26.

The backrest frame 1 and the sitting surface frame 2 are assembled to each other in a crossover area 4. In particular, the longitudinal members 15 of the sitting surface frame are mounted so that they can slide in substantially transverse grooves 16 in the longitudinal members 14 of the backrest frame. The grooves 16 of the backrest frame have a width greater than the width of the longitudinal members 15 of the sitting surface frame.

By substantially aligning the longitudinal directions of the grooves 16 and the longitudinal members 15 of the sitting surface frame, the backrest frame can slide from front to back along the sitting surface frame. In this way a user can move the lounger from one stable configuration to another, for example from a stretched out first configuration shown in FIGS. 2 and 3 to a raised (sitting up) second configuration shown in FIG. 4.

The stable configurations of the seat are obtained by wedging the lateral longitudinal members 15 of the sitting surface frame in the grooves 16 of the backrest frame. By virtue of their respective weights, the sitting surface and backrest frames are positioned relative to each other such that (as shown in FIGS. 2 and 3) each longitudinal member 15 of the sitting surface frame is immobilized in the grooves 16 of the backrest frame. Each longitudinal member 15 of the sitting surface frame is in non-sliding contact at two immobilizing points: on the upper rear part of the groove in which it is mounted and on the lower front part of the same groove. By definition of immobilization by wedging, the greater the normal force between a longitudinal member of the sitting surface frame and the groove of the backrest frame (at the two immobilizing points), the stronger the immobilization in a longitudinal sliding direction. The immobilization by wedging is therefore stronger and the seat is therefore more stable in its configuration when a user is sitting in the seat.

Retention of one frame relative to the other by wedging is in particular more effective if:

the coefficient of friction between the material of the longitudinal members 15 of the sitting surface frame and the material of the sides of the grooves 16 of the backrest frame is high, the lower front and upper rear points of contact between a longitudinal member and the sides of a groove are far apart and thus the groove is longer.

This is why in the advantageous embodiment of the invention shown in FIGS. 1 to 4 the longitudinal members 14 of the backrest frame are widened at the level of the grooves 16. The grooves 16 are therefore longer, which improves the wedging of one frame relative to the other.

Moreover, such enlargement of the longitudinal members of the backrest frame in the crossover area enables the provision of more or less pronounced armrests enabling entry and exit of the seat to be facilitated for a user who is able to lean thereon.

Moreover, such armrests locally reinforce the longitudinal members 14 of the backrest frame in which it is then advantageous to produce the grooves 16 for assembling it with the sitting surface frame. It is particularly advantageous to dispose reinforced longitudinal members 14 of the backrest frame in the crossover area, which is subjected to high loads when a user is sitting in the chair.

Moreover, the longitudinal members 14, 15 of the sitting surface and backrest frames have rounded top and bottom surfaces for greater comfort and improved esthetics. The grooves 16 therefore also have a gutter shape at the top and bottom to accept the longitudinal members of the sitting surface frame. The wedging effect is therefore reinforced because the area of contact between a longitudinal member and the gutters of a cooperating groove is increased.

Moreover, the gutter shape of the grooves 16 enables lateral guiding of the longitudinal members 15 of the sitting surface frame.

It is to be noted that the width of the longitudinal members of the sitting surface frame is smaller than the width of the longitudinal members of the backrest frame (at least where they cross the backrest frame and therefore at the level of the grooves and where applicable the armrests).

This way of assembling the sitting surface and backrest frames enables the lounger to be configured in any position between two extreme configurations corresponding to the most upright sitting configuration on the one hand and the most stretched out configuration on the other hand.

Furthermore, in the embodiment of the invention shown in FIGS. 1 to 4, the lounger is equipped with a flexible sheet 3 of which at least a transition panel 18 extends between an area 9 of intersection with the rigid sitting surface 8 and a suspension crossmember 7. The lateral edges 27 of the flexible sheet and more particularly of the transition panel are free, i.e. neither guided nor elastically loaded.

The seat includes joining means consisting of a slot 10 formed by the gap between two successive slats 21 in the area 9 of intersection with the rigid sitting surface 8. The flexible sheet 3 passes through this slot 10 so that the flexible sheet always has the same area 9 of intersection with the rigid sitting surface. This therefore imposes the passage of the flexible sheet through this predetermined area 9 of intersection, and this slot 10 constitutes a device for changing the direction of the flexible sheet adapted to hold the transition panel 18 in position regardless of the level of tension in the flexible sheet between its two anchor points 17, including when a user is sitting in the seat.

The transition panel 18 of the flexible sheet has a length greater than the minimum distance between the suspension crossmember 7 and the intersection area 9. The transition panel therefore forms a bulge by virtue of the effect of its own weight. The flexible sheet has a sufficient width from one lateral edge 27 to the other to support a user in a stable manner.

In the embodiment shown in FIGS. 1 to 4 the suspension crossmember 7 is in the vicinity of the top end of the backrest frame.

The transition panel 18 therefore provides a transition between the backrest and the rigid sitting surface. In fact, the flexible sheet is tangential to the sitting surface. A progressive transition is therefore established by the transition panel between the flexibility of the backrest produced by the flexible sheet and the rigidity of the rigid sitting surface.

In fact, the rigid sitting surface has a rear sitting surface portion extending to the rear of the intersection area 9, between the intersection area 9 and a rear edge 25 of the rigid sitting surface. This rear sitting surface portion enables support to be provided for the pelvis of the user. The rear sitting surface portion is advantageously inclined toward the rear of the chair.

The flexible sheet is adjusted by the effect of the weight and the morphology of the user and an anterior portion of the transition panel 18 holds the pelvis of the user in position.

In particular, in some configurations like that shown in FIG. 4, an anterior portion of the transition panel is in contact with an anterior area, called the superposition portion, of the rear sitting surface portion, so that said superposition portion extends between the intersection area 9 and an area 24, called the separation area, in which the transition panel separates from the rigid sitting surface. In said superposition portion, the anterior portion of the transition panel is wedged between the rear sitting surface portion and the user's buttocks so that the flexible sheet is tensioned and forms a flexible and continuous transition between the rigid sitting surface and the backrest. The user's pelvis is therefore perfectly supported in the superposition portion, in which the transition panel provides a transition between the rigid sitting surface and a backrest. This is especially so when the position of the separation area (and therefore the length of the superposition portion) is variable as a function of the height, morphology and weight of the user.

In other, particularly advantageous, configurations of the seat, the transition panel 18 is in contact with an area, called the superposition portion, situated toward the front of the rear sitting surface portion only when a user is in the process of sitting down but has not yet leaned back in the seat, as represented in FIG. 2. During a first stage of a user sitting down in the seat, the user is therefore seated entirely on the rigid sitting surface, notably with their buttocks pressed against the superposition portion extending from a separation area 24 to the intersection area 9 of the rigid rear sitting surface portion.

In fact, as shown in FIG. 2, the anterior portion of the transition panel of the flexible sheet is wedged between the user whose weight is exerted on the flexible sheet and the rear sitting surface portion. The rear portion of the rigid sitting surface being inclined towards the rear, this intermediate stage when a user sits down in the seat enables the user's pelvis to be held in such a way as to preserve the natural lordosis of the lumbar vertebrae.

In a second step in which a user sitting down in the seat leans back in it, the separation area 24 is moved toward the front until, in some advantageous configurations like that shown in FIG. 3, it coincides with the intersection area 9, so that the separated portion coincides with the rear sitting surface portion and the superposition portion disappears. The user is therefore suspended in the transition panel of the flexible sheet and the only pressure exerted on the transition panel is that caused by the weight of the user, which is compensated by the reaction of the joining means 10 and the suspension device 7.

Surprisingly, although the rear sitting surface portion no longer exerts any direct reaction to the weight of the user (notably directly on the user's buttocks), the user is seated comfortably. In fact, the pelvis has been held in a position such that the natural lordosis of the lumbar vertebrae is initially respected after which this position of the pelvis is maintained and respected thanks to the support provided by the transition panel.

Moreover, the flexible sheet is extended beyond the intersection area 9 toward the front of the rigid sitting surface and passes alternately over and under the slats 21 forming the rigid sitting surface.

The flexible sheet is also extended beyond the suspension crossmember 7 and includes a supporting panel 19 that extends from the suspension crossmember 7 to a direction-changing device 5. The direction-changing device is advantageously a direction-changing crossmember 5 connecting the two longitudinal members 14 of the backrest frame. This direction-changing crossmember 5 enables modification of the main direction of the flexible sheet and therefore, when the flexible sheet is tensioned, production of a supporting panel 19 tensioned between the suspension crossmember 7 and the direction-changing crossmember 5.

Depending on the configuration of the seat, the flexible sheet can pass through other direction-changing devices. Thus, in FIG. 4, for example, the rear edge 25 of the rigid sitting surface forms a direction-changing device for the flexible sheet.

The flexible sheet is in particular tensioned between two points 17 at which it is anchored to the sitting surface and backrest frames when a user is sitting on the chair. The flexible sheet is tensioned by the weight of the user exerted on the transition panel. In fact, the flexible sheet is mounted so as to slide over the suspension crossmember and the direction-changing crossmember. The flexible sheet can slide from front to back (and from back to front) on each of the direction-changing devices (direction-changing crossmember, suspension crossmember, slat forming the rear edge 25 of the rigid sitting surface, etc.). In this way, the length of each of the panels of the flexible sheet is automatically adapted to the configuration of the chair and to the weight and the morphology of the user each time the chair is used.

In particular, when a user sits down on the chair, and thus on the transition panel 18, as shown in FIG. 2, the flexible sheet is tensioned between its two anchor points 17, the transition panel lengthens, forming a more pronounced downward bulge, and the supporting panel 19 is tensioned between the suspension crossmember 7 and the direction-changing crossmember 5.

Once the user is completely seated in the seat, as shown in FIG. 3, the transition panel comes into contact with the supporting panel over at least a portion of the backrest formed by the transition panel. The supporting panel 19 being tensioned, it creates additional support for the backrest, and therefore for the back of the user, which makes this kind of lounger more comfortable.

Moreover, the length of the transition panel is automatically adapted as a function of the configuration of the chair. In fact, the length of the panel 20, called the self-regulation panel, of the flexible sheet situated between the anchor point 17 near the back leg assembly 12 and the rear edge 25 of the rigid sitting surface varies as a function of the configuration of the chair. In fact, the length of the self-regulation panel 20 depends on the configuration of the lounger as may be seen on comparing FIGS. 2 and 3 with FIG. 4: the self-regulation panel 20 is longer in the sitting configuration (FIG. 4) than in the stretched out position (FIGS. 2 and 3). Now, in the sitting position, the suspension device 7 is farther towards the front of the chair and the distance between the suspension device 7 and the intersection area 9 is therefore shorter. Without the self-regulation panel 20 there would therefore be an excess length of the transition panel 18 that would form a bulge that was too large and in any event too low when a user sat in the seat.

The self-regulation panel 20 can also make it possible to vary the tension felt in the transition panel as a function of the position of the chair: thus there could be provision for the backrest to be more flexible in the sitting position than in the stretched out position, or vice versa, as a function of the disposition of the self-regulation panel.

The flexible sheet 3 is anchored at its two ends by two anchor points 17. The anchor points 17 may be produced in numerous ways. However, in the embodiment shown in FIGS. 1 to 4, the two ends of the flexible sheet are advantageously hemmed and passed through a slot. A crossbar 6 introduced into the hemmed end prevents the hemmed end of the flexible sheet going back through the slot provided that the diameter of the crossbar 6 is greater than the width of the slot.

Furthermore, a lounger in accordance with the invention shown in FIGS. 1 to 4 comprises:

- a wooden backrest frame 1 having a linear length of approximately 180 cm, a curvature with a radius of approximately 1.5 m and longitudinal members with a section of 5 cm×8 cm on average, widened at the level of the grooves 16 to a section of approximately 5 cm×24 cm,
- a wooden sitting surface frame 2 having a linear length of approximately 130 cm, a curvature with a radius of approximately 1.1 meters and longitudinal members with a section of 3 cm×5.5 cm on average,
- a flexible sheet formed of a substantially non-extensible (rigid in traction) strip of canvas, with a total length from one anchor point to another of approximately 3 meters, the transition panel of which has a length (from the suspension device to the intersection area) between 115 cm and 130 cm in the stretched out configuration of FIGS. 2 and 3 and between 95 cm and 110 cm in the sitting configuration of FIG. 4, the possible variations relating notably to the weight of the user of the lounger,
- a rigid sitting surface 8, approximately 55 cm wide and approximately 100 cm long including an approximately 30 cm rear sitting surface portion between the intersection area 9 and the rear edge 25, the slats 21 of the rigid sitting surface being made of wood.

Moreover, in order as much to enable sliding of the longitudinal members of the sitting surface frame in the grooves 16 of the backrest frame to go from one configuration to another as to enable immobilization of the first relative to the second by wedging, the grooves have a length of approximately 23 cm and a width of approximately 5.9 cm.

Furthermore, such a lounger may be offered in the form of a kit of parts to be assembled. In fact, the slats 11, 21, the longitudinal members 14, 15 of the sitting surface and backrest frames, the direction-changing and suspension crossmembers 5, 7, the flexible sheet 3, and the anchor bars 6 may be assembled together, for example by screws and/or by self-assembly (bending, nesting. etc.) means. In the demounted state, these components may be disposed within a transportable volume, in particular of small thickness, for example having a thickness less than or equal to 10 cm.

Moreover, the longitudinal members 14, 15 of the sitting surface and backrest frames may each consist of two components adapted to be assembled (bending, nesting, etc.) in order to reduce their overall size when packaged and offered for sale, so as to be able to sell such a chair in a package of substantially parallelepiped shape having dimensions of approximately 100 cm×60 cm×10 cm.

In a second embodiment of a seat in accordance with the invention shown in FIGS. 5 and 6 the seat is a folding chair.

The chair of this second embodiment of the invention includes at least two longitudinal members 14 forming a sitting surface frame and two longitudinal members 15 forming a backrest frame that cross over in a crossover area 4 at the level of which they are articulated so as to be able to pivot relative to each other about this crossover area. The longitudinal members 14, 15 of the sitting surface and backrest frames can therefore either be held in a stable open configuration adapted to accept a user, as shown in FIG. 5, or folded against each other so that the chair can easily be transported, as shown in FIG. 6.

The longitudinal members 14, 15 of the sitting surface and backrest frames are advantageously curved.

The folding chair has a rigid sitting surface 8 extending from a rear edge 25 to a front edge 26. It advantageously follows the curvature of the longitudinal members 14 of the sitting surface frame and is fixed by its lateral edges. The rigid sitting surface 8 is advantageously inclined downwards towards the rear, so that its front edge 26 is higher than its rear edge 25, notably when the chair is set down on the ground in a stable configuration (as shown in FIG. 5) in which the longitudinal members 14, 15 of the sitting surface and backrest frames respectively form a rear leg assembly 12 and a front leg assembly 13.

A flexible sheet suspension device 7 is installed between the upper portions of the two longitudinal members of the backrest frame.

This chair includes a flexible sheet 3 with free edges 17 and extending between an area 9 of intersection with the rigid sitting surface 8 and the suspension device 7. The flexible sheet 3 corresponds exactly to the transition panel 18.

The suspension crossmember 7 is advantageously mounted so as to be mobile in rotation about an axis 23 relative to the longitudinal members 14 of the backrest frame. As shown in FIG. 2, when a user sits down in the seat the suspension crossbar 7 is therefore oriented in the same direction as the transition panel 18 of the flexible sheet so as to offer up a surface continuous with the transition panel 18, as shown in FIG. 3, regardless of the configuration of the seat and the characteristics of the user. The suspension crossmember 7 advantageously serves as a headrest for a user.

The length of the flexible sheet is chosen so that, in a stable configuration of the chair, the transition panel separates from the rigid sitting surface in a separation area 24 situated in a rear portion of the rigid sitting surface, said rear portion extending between the rear edge 25 and the intersection area 9.

The invention may be the subject of numerous other variant embodiments that are not shown.

For example, the transition and supporting panels 18, 19 may advantageously each have an additional strip, which strips cross each other. The supporting panel 19 can therefore have a strip extending laterally from one edge to the other of the supporting panel to provide passage for a strip extending longitudinally to the rear of the transition panel 18. This enables the supporting panel 18 to be pulled towards the rear, so as to maintain the bulging shape of the transition panel.

In particular, a seat in accordance with the invention may have a rigid backrest portion situated above and/or to the rear of the transition panel of the flexible sheet.

Moreover, the sheet may be of different kinds and materials: for example, such a flexible sheet may be produced by means of a plurality of cords, narrow strips or a single strip of canvas. The material used for a flexible sheet in accordance with the invention is advantageously inelastic.

There is nothing to prevent a flexible sheet in accordance with the invention being a continuous sheet and therefore having no anchorages. The suspension, junction and direction-changing means are then essential to retaining the flexible sheet in position.

Moreover, a seat in accordance with the invention may be non-adjustable and therefore have a single stable configuration.

There is nothing to prevent forming a rigid sitting surface in materials and forms other than a series of slats. It may be a uniform surface, for example.

The sitting surface and backrest frames may have any other kind of shape, for example straight, corrugated, etc. They may also be adjusted relative to each other to modify the configuration of the seat by assembly means other than wedging.

Moreover, the various flexible sheet direction-changing devices (direction-changing crossmember 5, suspension device 7, intersection area slot 10) may be provided by other means. For example, the slot of the joining means may advantageously be replaced by an area in which the flexible sheet is fixed to the rigid sitting surface, so that it is also an anchor point for the flexible sheet. For example, they could take the form of a slot mobile along the rigid sitting surface.

Furthermore, a seat in accordance with the invention could have a self-regulation panel 20 (enabling in particular adjustment of the length of the transition panel) elsewhere on the seat: for example at the front, underneath, on top, etc. A seat in accordance with the invention may also include a plurality of self-regulation panels, possibly complementary with each other and providing a function equivalent to that of the self-regulation panel described in one particular embodiment.

A suspension crossmember serving as a headrest is not necessarily mounted so that it can rotate relative to the backrest frame; it may be fixedly mounted. In particular, a suspension crossmember in accordance with the invention may be of convex shape so as to preserve a continuous (non-abrupt) curvature of the flexible sheet.

A seat in accordance with the invention may also be designed so that it can be folded into a relatively compact configuration in which the longitudinal members 15 of the sitting surface frame are aligned, by rotation about the crossover area 4, with the longitudinal members 14 of the backrest frame, thereby facilitating transport and storage.

Furthermore there is nothing to prevent the rear edge 25 and the front edge 26 of a seat in accordance with the invention respectively forming back and/or front leg assemblies.

The area of physical intersection between a backrest frame and a sitting surface frame may be toward the front of the seat in some particular embodiments, the area of intersection of a backrest portion and a rigid sitting surface portion still being towards the rear of the seat.

The invention claimed is:

1. A seat comprising:

a rigid sitting surface (8) having a rear edge (25), a flexible sheet (3) which is rigid under traction, a direction-changing device (5) from which the flexible sheet (3) extends, a backrest frame (1) including a device (7) for suspension of said flexible sheet (3), wherein the flexible sheet (3) is joined to the rigid sitting surface (8) to extend from an intersection area (9) of the rigid sitting surface (8), said intersection area (9) being located in front of the rear edge (25) of the rigid sitting surface (8) so that the rigid sitting surface has a rear sitting surface portion extending from said intersection area (9) to the rear edge (25) of the rigid sitting surface, such that, in at least one stable configuration of the seat:

the suspension device (7) is higher than the rigid sitting surface (8), the intersection area (9) is, as a whole, in front of the suspension device (7), the direction-changing device (5) is located below the suspension device (7) and behind the intersection area (9), said flexible sheet (3) includes a transition panel (18) that extends between the suspension device (7) and the intersection area (9);

whereby said flexible sheet (3) continues to form at least one supporting panel (19) located behind the transition panel (18), the supporting panel (19) extending between the suspension device (7) and the direction-changing device (5), and such that said flexible sheet (3) is not fixed to the suspension device (7) and is therefore able to move with respect to the suspension device (7), and whereby the flexible sheet (3) has a length such that the transition panel (18) is spaced apart from the rigid sitting surface (8) to define a separated portion of the rigid sitting surface (8).

2. The seat as claimed in claim 1, wherein the length of the flexible sheet (3) is adapted to be able, when a user sits down in the seat, to decrease the extent of the separated portion, thereby tensioning the flexible sheet (3), and whereby the supporting panel (19) is then able to increase the firmness of a backrest portion formed by the transition panel (18).

3. The seat as claimed in claim 1, wherein at least one front portion of the separated portion is inclined downwards towards the rear.

4. The seat as claimed in claim 1, wherein said at least one front portion of the separated portion is curved and has a convexity which is oriented upwards.

5. The seat as claimed in claim 1, wherein the rigid sitting surface (8) is inclined downwards towards the rear along a convex profile, which is curved as a whole, with a convexity which is oriented upwards.

6. The seat as claimed in claim 1, wherein the seat includes a frame adapted to be placed in at least two different stable configurations, the length of the transition panel (18) varying as a function of the configuration of the seat.

7. The seat as claimed in claim 1, wherein the seat comprises:

a rigid sitting surface frame (2), a rigid backrest frame (1) different from the sitting surface frame (2) and including the suspension device (7) of the flexible sheet (3), said sitting surface and backrest frames (1, 2) being assembled to each other so as to be able to form said at least one stable configuration of the seat in which they cross over in the crossover area (4), the backrest frame extending upwards relative to the crossover area and the sitting surface frame having the rigid sitting surface (8) in front of the crossover area.

8. The seat as claimed in claim 7, wherein:

the sitting surface frame (2) has, as a whole, an elongate shape and forms a back leg assembly (12) of the seat, the backrest frame (1) has, as a whole, an elongate shape and forms a front leg assembly (13) of the seat.

9. The seat as claimed in claim 7, wherein said sitting surface and backrest frames (1, 2) include assembly means enabling them to slide relative to each other to go from one stable configuration of the seat to another stable configuration of the seat.

10. The seat as claimed in claim 9, wherein the backrest frame (1) includes grooves (16) and the sitting surface frame (2) includes tongues, the grooves and the tongues being adapted so that:

the tongues can slide longitudinally in the grooves to go from one stable configuration of the seat to another stable configuration of the seat, the tongues can be immobilized by wedging in the grooves for each configuration of the seat between at least first and second stable configurations of the seat.

11. The seat as claimed in claim 1, wherein the seat is provided in kit form including packaged components, said components including at least:

a backrest frame (1), a rigid sitting surface (8), a flexible sheet (3), a direction-changing device (5), a device (7) for suspension of the flexible sheet.

12. A seat comprising:

a rigid sitting surface (8) having a rear edge (25), a rigid sitting surface frame (2), a flexible sheet (3) which is rigid under traction, a backrest frame (1) including a device (7) for suspension of said flexible sheet (3), wherein the flexible sheet (3) is joined to the rigid sitting surface (8) to extend from an intersection area (9) of the rigid sitting surface (8), said intersection area (9) being located in front of the rear edge (25) of the rigid sitting surface (8) so that the rigid sitting surface has a rear sitting surface portion extending from said intersection area (9) to the rear edge (25) of the rigid sitting surface, such that:

the suspension device (7) is higher than the rigid sitting surface (8), the intersection area (9) is, as a whole, in front of the suspension device (7), said flexible sheet (3) includes a transition panel (18):

extending between the suspension device (7) and the intersection area (9), having a length such that the transition panel (18) is spaced apart from the rigid sitting surface (8) to define a separated portion of the rigid sitting surface (8), the sitting surface frame (2) forms a back leg assembly of the seat, at least one front portion of the separated portion is inclined downwards towards the rear and is curved, having a convexity which is oriented upwards.

13. The seat as claimed in claim 12, wherein the rigid sitting surface (8) is inclined downwards towards the rear along a convex profile, which is curved as a whole, with a convexity which is oriented upwards.

14. The seat as claimed in claim 12, wherein the length of the transition panel (18) is adapted to be able, when a user sits down in the seat, to decrease the extent of the separated portion, thereby tensioning the flexible sheet (3).

15. The seat as claimed in claim 12, wherein the seat is provided in kit form including packaged components, said components including at least:

a backrest frame (1), a rigid sitting surface (8), a flexible sheet (3), a device (7) for suspension of the flexible sheet.

16. A seat comprising:

a rigid sitting surface (8) having a rear edge (25), a flexible sheet (3) which is rigid under traction, a backrest frame (1) including a device (7) for suspension of said flexible sheet (3), wherein the flexible sheet (3) is joined to the rigid sitting surface (8) to extend from an intersection area (9) of the rigid sitting surface (8), said intersection area (9) being located in front of the rear edge (25) of the rigid sitting surface (8) so that the rigid sitting surface has a rear sitting surface portion extending from said intersection area (9) to the rear edge (25) of the rigid sitting surface, such that:

the suspension device (7) is higher than the rigid sitting surface (8), the intersection area (9) is, as a whole, in front of the suspension device (7), said flexible sheet (3) includes a transition panel (18):

extending between the suspension device (7) and the intersection area (9), having a length adapted to define an area of separation (24) of the flexible sheet relative to the rigid sitting surface (8) in which the transition panel separates from contact with the rigid sitting surface (8), said separation area (24) intermediating between the rear edge (25) of the rigid sitting surface (8) and said intersection area (9) and being located behind said intersection area (9) when the transition panel (18) is subjected only to its own weight, said separation area (24) dividing the rear sitting surface portion of the rigid sitting surface (8) into a separated portion and a superposition portion;

whereby the transition panel (18) is spaced apart from the rigid sitting surface (8) at said separated portion, which extends from the rear edge (25) to the separation area (24), and whereby the transition panel (18) is in contact with the rigid sitting surface (8) at said superposition portion, which extends from the separation area (24) to the intersection area (9), at least one front portion of the separated portion is inclined downwards towards the rear and is curved, having a convexity which is oriented upwards.

17. The seat as claimed in claim 16, wherein the rigid sitting surface (8) is inclined downwards towards the rear along a convex profile, which is curved as a whole, with a convexity which is oriented upwards.

18. The seat as claimed in claim 16, wherein the length of the transition panel (18) is adapted to be able, when a user sits down in the seat, to increase the extent of the superposition portion and decrease the extent of the separated portion, thereby tensioning the flexible sheet (3).

19. The seat as claimed in claim 16, wherein the flexible sheet (3) continues to form at least one supporting panel (19) located behind the transition panel (18), the supporting panel (19) extending between the suspension device (7) and the rigid sitting surface (8), and such that said flexible sheet (3) is not fixed to the suspension device (7) and is therefore able to move with respect to the suspension device (7).

20. The seat as claimed in claim 16, wherein the seat is provided in kit form including packaged components, said components including at least:

a backrest frame (1), a rigid sitting surface (8), a flexible sheet (3), a device (7) for suspension of the flexible sheet.

* * * * *